United States Patent [19]

Sauder

[11] 4,341,380

[45] Jul. 27, 1982

[54] BODY CELL THERAPEUTIC DEVICE

[76] Inventor: Walter J. Sauder, 5551 Randolph Blvd., San Antonio, Tex. 78233

[21] Appl. No.: 201,743

[22] Filed: Oct. 29, 1980

[51] Int. Cl.[3] ..... A63B 5/08

[52] U.S. Cl. ..... 272/65; 272/144; 272/93; 128/25 R

[58] Field of Search ..... 272/55, 65, 66, 70, 272/93, 109, 114, 144, 146, 97; 128/25 R, 44

[56] References Cited

U.S. PATENT DOCUMENTS

| | | | |
|---|---|---|---|
| 1,470,403 | 10/1923 | Thalken | 272/114 X |
| 1,509,750 | 9/1924 | Campbell | 272/65 X |
| 3,062,542 | 11/1962 | Evancha | 272/55 X |
| 3,065,962 | 11/1962 | Hoffmeister | 272/114 X |
| 3,205,596 | 9/1965 | Hoffmeister | 272/70 X |
| 3,307,534 | 3/1967 | Gibbs | 272/144 X |
| 3,325,137 | 6/1967 | Knudsen | 272/144 X |
| 3,628,791 | 12/1971 | Garcia | 272/144 X |
| 3,638,940 | 2/1972 | Mehaulic | 272/144 X |
| 3,701,529 | 10/1972 | Kruthaupt | 272/70 X |
| 3,936,047 | 2/1976 | Brandt et al. | 272/146 |

FOREIGN PATENT DOCUMENTS

| | | | |
|---|---|---|---|
| 2848272 | 5/1979 | Fed. Rep. of Germany | 272/65 |

*Primary Examiner*—Richard J. Apley
*Attorney, Agent, or Firm*—Gunn, Lee & Jackson

[57] ABSTRACT

A therapeutic device comprising a base, usually resting upon a floor, and a platform, usually located above the base that is maintained rigidly parallel to the base in a horizontal plane throughout up and down cycles. The platform is attached either with (a) pivotally attached arm(s) or by (b) freely operating sleeve(s) on to one or more vertical extensions or rigid attachments to/of the base. The platform, upon which the user is located, is moved up and down in a cycle initiated and maintained by the sustained activity of a spring suspension, or by, or in combination with, a motor driven reciprocal drive. This up and down cycle of accelerating and decelerating in line with extant gravitational pull occurs resultant strengthening of the body cells and organs, and stimulates circulation and body functions for the occupant user.

13 Claims, 3 Drawing Figures

BODY CELL THERAPEUTIC DEVICE

BACKGROUND OF THE INVENTION

It has been generally accepted that the human body, its components, and functions are stressed, stimulated and thereby strengthened in all activities involving resistance to the extant gravitational pull or force.

It has been further established the body does not physiologically discern between the forces of inertia, acceleration and deceleration and gravitational pull. Hence G-force stress may be induced and experienced by acceleration or deceleration even when extant planetary G-force is essentially non-existant. Those G-forces of acceleration and deceleration can be induced in line with such existant G-force, when present, thereby combining with and producing the summary effect of both.

When people run, jump, play tennis, or are in any way move in resistance to G-forces, the body, its organs and cells are stressed and strengthening is induced. Body fluid circulation and waste functions are also stimulated and benefitted. Many people are, however, either disinclined or due to physical impairment or pain cannot participate in these exertions and as a result their bodies and components and functions deteriorate and fail.

The present invention utilizes all three sources of G-forces to induce those benefits for its users with minimal physical exertion by the individual user. In fact should the user be unable to activate the invention device himself, a second person or motor powered reciprocal drive can be used to provide the necessary motion to allow the device user the benefit from the invention device, even if the user is totally passive, incapacitated, in a wheelchair, or bed.

BRIEF DESCRIPTION OF THE PRIOR ART

Several devices utilizing a spring to provide bounce to a platform are shown in U.S. Pat. Nos. 2,764,413; 2,812,180; and 3,856,296. All of these devices, however, are directed to diving boards or springboards that do not maintain a horizontal plane. These would require skill by the user that an older or sick person may not have. Matton in U.S. Pat. No. 2,915,055 does show an exercising chair useful for flexing the limbs and exercising the joints. Movement of the chair is created by pivotally mounted arms engaging the chair and a motor mounted below the seat of the chair. However, the device of Matton provides only limited movement of selected areas of the body and does not strengthen the body cells of the entire body as does the invention device.

Trampolines provide a user with similar benefits combining the same G-forces of acceleration, deceleration, and extant gravity, but do not provide the platform, on which the user may sit, stand with shoes, or even be in a wheelchair, stably maintained horizontal and parallel to the base in the accelerated up and down motion as does the invention device. More over the use of trampolines, springboards or diving boards require skills and balance without which are considered unsafe, nor are they reasonably usable for the passive person or one confined to a wheelchair. The invention device can be used by anyone regardless of skill or strength or balance. With easily accomplished assistance the totally incapacitated person can use the invention device, even those where body joint movement or flexing of limbs would be undesirable or painful as may occur by use of the Matton device.

SUMMARY OF THE INVENTION

It is an object of the present invention to provide a therapeutic device that strengthens body cells and organs, and improves body functions and fluid circulation. The invention device comprises a platform that is pivotally attached to a vertical upright that is part of, or attached to, a base generally below and parallel to the platform. The pivotal attachment allows free up and down movement of the platform and at the same time maintains the platform rigidly horizontal and parallel to the base during the vertical movement cycle regardless of where on the surface of the platform the users/occupants weight is centered or located. This gives the user/occupant essentially perfect stability getting on and off the platform and during use.

The platform movement is either spring actuated or is actuated in combination with (or by) a reciprocal mechanical drive. Spring actuation is accomplished by any type spring such as compression, extension, torsion, etc.

The following are examples:

A. Compression
1. attached to the top of the base extending up (between) and attached to the bottom of the platform.
2. attached to and extending from the pivotal arms or extensions or attachments thereof.

B. Extension
1. attached to the top of either the pivotal arms or the platform or attachments or extension thereof and extending to any horizontal support above that is either attached to or an extension of the base.
2. attached to the pivotal arms or the platform or extensions or attachments thereof and extending to any part of the base, extension or attachment thereof, or otherwise secured.

C. Torsion

Located over the permanently horizontal part of one of the pivotal arms attached to a sprocket, worm gear drive, or an attachment or extension of the base and the other end to the supporting arms of the pivotal arm. In the use of the worm driven sprocket a motor drive or crank, can be used to increase or decrease tension for load adjustment or raising and lowering of the platform.

It must be further noted that platform raising or lowering, or changes in spring tension of any spring configuration, can be effected by making the spring end attachments moveable for the increase or decrease of compression or extension as well as torsion. This can be accomplished by parallel loading of a rotatable screw, turning of which may be either manual or motor driven. Other means common in the art may be utilized to accomplish the same function.

It is a further object of this invention to provide a therapeutic device comprising a spring or otherwise reciprocally actuated rigid platform having one or more rigid upright attachments or extensions slidably engaged with the vertical uprights, which are rigidly attached to (or extensions of) a base. Those vertical uprights or extensions may be slidably engaged with rollers or balls or other guides maintaining alignment and horizontal stability to the platform during up and down motion. Spring attachment or other reciprocal drive can be by any of those aforementioned methods or other known in the art.

It is a further object of the invention to have (a) hand support(s) or seat which may be attached to the platform.

It is a further object of the invention to have a platform that may be raised or lowered for easier entrance by the user; for example, loading with an individual in a wheelchair.

It is a further object of the invention that the up and down reciprocal motion can be supplied by mechanical-/electrical means with or without springs.

It is a further object of the invention that in either of the basic configurations given, the verticals to which the platform is either pivotally or slidably attached may be rigidly secured to a floor or wall, thereby eliminating the necessity of a base.

DESCRIPTION OF THE PREFERRED EMBODIMENT

Figure 1:
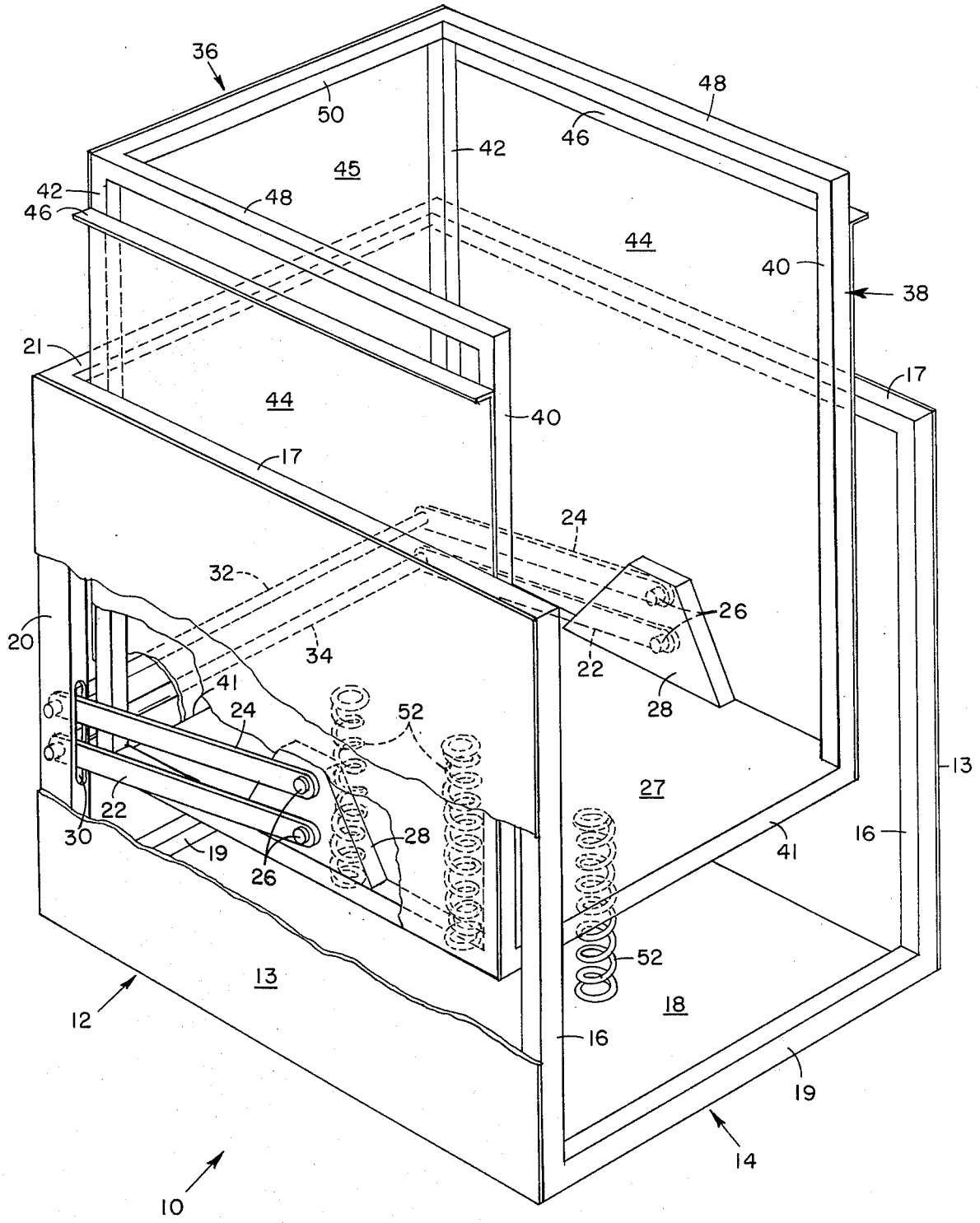
FIG. 1 is a perspective partially cut-away view of the invention therapeutic device showing a platform pivotally mounted and coil springs beneath the platform.

For a detailed description of the invention, reference is made to the attached drawings wherein the invention is illustrated and will be described. Identical reference characters will be utilized to refer to identical or equivalent components throughout the various views and the following description.

The invention body cell therapeutic device 10 shown in FIG. 1 comprises an outer box 12 having an outer box frame 14 with walls 13 attached thereto and an inner box 36 having an inner box frame 38 with walls 44 attached thereto and a spring-actuated rigid platform 27.

Outer box 12 is a U-shaped configuration with rearward verticals 16 and forward verticals 20 forming the four corner posts of the frame 14 with upper and lower horizontals 17 and 19, respectively, connecting the corner posts to form the box-like frame 14. These verticals 16 and 20 and horizontals 17 and 19 may be constructed of any sturdy, rigid, durable material, but are preferably made of steel or aluminum.

Attached to the outside edges of outer box frame 14 by conventional means are walls 13 and base 18. Any sturdy material may be used to form walls 13 and base 18 such as plywood, aluminum or sheet steel, with sheet steel being preferred. Walls 13 and base 18 provide enclosure means for the moving parts (to be discussed below) of the device for safety and aesthetic reasons.

Pivotally engaging the frame 14 of outer box 12 is inner box 36. Inner box 36 has a configuration similar to that of outer box 12, namely a U-shaped frame 38 having walls 44 attached to the outside thereof. Again, similar to outer box 12, inner box frame 38 comprises rearward verticals 40 and forward verticals 42 forming the corner posts of the U-shaped frame with lower horizontals 41 connecting the lower ends of the four verticals 40 and 42, and upper horizontals connecting the upper ends. However, in the inner box 36, although lower horizontals 41 are positioned relatively the same and perform the same function as the lower horizontals 19 in outer box 12, upper horizontals 48 connecting upper ends of the four corner posts not only provide connecting and support means for the inner box frame 38, but also function as handrails for the occupant of the device.

Handrails 48 are made possible by not bringing the inner box walls 44 flush with the top surface of the handrails 48 in contrast to the outer box 12 design. Walls 44 are extended up to within a few inches of the bottom of handrail 48 and then are bent outward to form an L-shaped lip 46. This lip 46 may serve the dual purpose of providing a "stop" for the downward motion of the inner box 36 when the lip 46 contacts the outer box horizontals 17, and prevent the hands of a person using the device from getting caught between the inner box 36 and outer box 12. The inner box wall 45 located on the front of inner box 36 is, however, flush with the top surface of cross bar 50 that connects forward verticals 42 in the same manner as the design of outer box 12.

The components of inner box 36 equivalent to those of outer box 12 are made of the same materials as used in outer box 12.

Platform 27 attached to the bottom of inner box frame 38 forms the surface on which a user of the invention device is located. As with other parts of the invention device, this platform 27 should be sturdy, durable and strong and must be rigid. Preferably the platform is made of steel, but other materials meeting the above requirements may also be used.

Located approximately midway on opposite sides of the platform 27 are attachment blocks 28. These attachment blocks 28, preferably also made of steel and secured to the platform 27 by any conventional well-known means, retain one end of the rocker arms 22 and 24 (to be discussed below) by means of pivot points 26, which may be bolts or other equivalent retaining means. Rocker arms 22 and 24 are free to pivot on pivot points 26.

Rocker arms 22 and 24 which are rigidly attached to horizontal arms 32 and 34 form the means by which the platform 27 is able to move and the invention device to operate. Located between the outer box side 13 and inner box side walls 44, lower rocker arm 22 and parallel upper rocker arm 24 are secured to attachment blocks 28 by their respective pivot points 26. The inner box side walls 44 are constructed and arranged so they do not interfere with the pivotal attachment rocker arms 22 and 24. Each rocker arm extends forward and parallel to the walls 13 and 44, passing through slot 30 in the lower portion of forward verticals 20 and into the space between the side walls 44 of inner box 36 and walls 13 of outer box 12. The lower rocker arm 22 is connected to lower horizontal arm 34 and upper rocker arm 24 is connected to upper horizontal arm 32, connection being such that rocker arms 22 and 24 can pivot with horizontal arms 32 and 34. The horizontal arms 32 and 34 are pivotally supported by forward verticals 20. The rocker arms 22 and 24 are of equal length and form two sides of a parallelogram being always maintained vertical. Therefore upon a perpendicular attachment of one of the vertical sides through attachment blocks 28 to the platform 27, the platform 27 is always maintained horizontal even though the platform 27 moves in the same size arc as rocker arms 22 and 24.

As mentioned previously, all of the support and movement mechanism for the inner box 36, with the exception of attachment blocks 28, are enclosed between the walls 44 of inner box 36 and the walls 13 of outer box 12. Additionally, as with the other components of the invention device, the rocker arms 22 and 24, and the horizontal arms 32 and 34 are made of a strong, sturdy, durable material such as steel, although any other material fulfilling the necessary requirements may also be utilized.

Certainly one of the most critical components of the invention device are the springs 52, one end of which is attached to the base 18 of the outer box 12 and the opposite end is attached to the underneath side of platform 27 of inner box 36. The coil-type springs 52 are aligned in the center of the device 10. Although FIG. 1 shows three aligned coil springs, similar results may be obtained from the invention device by utilizing any type of springs and any number of springs arranged in any pattern.

Figure 2:
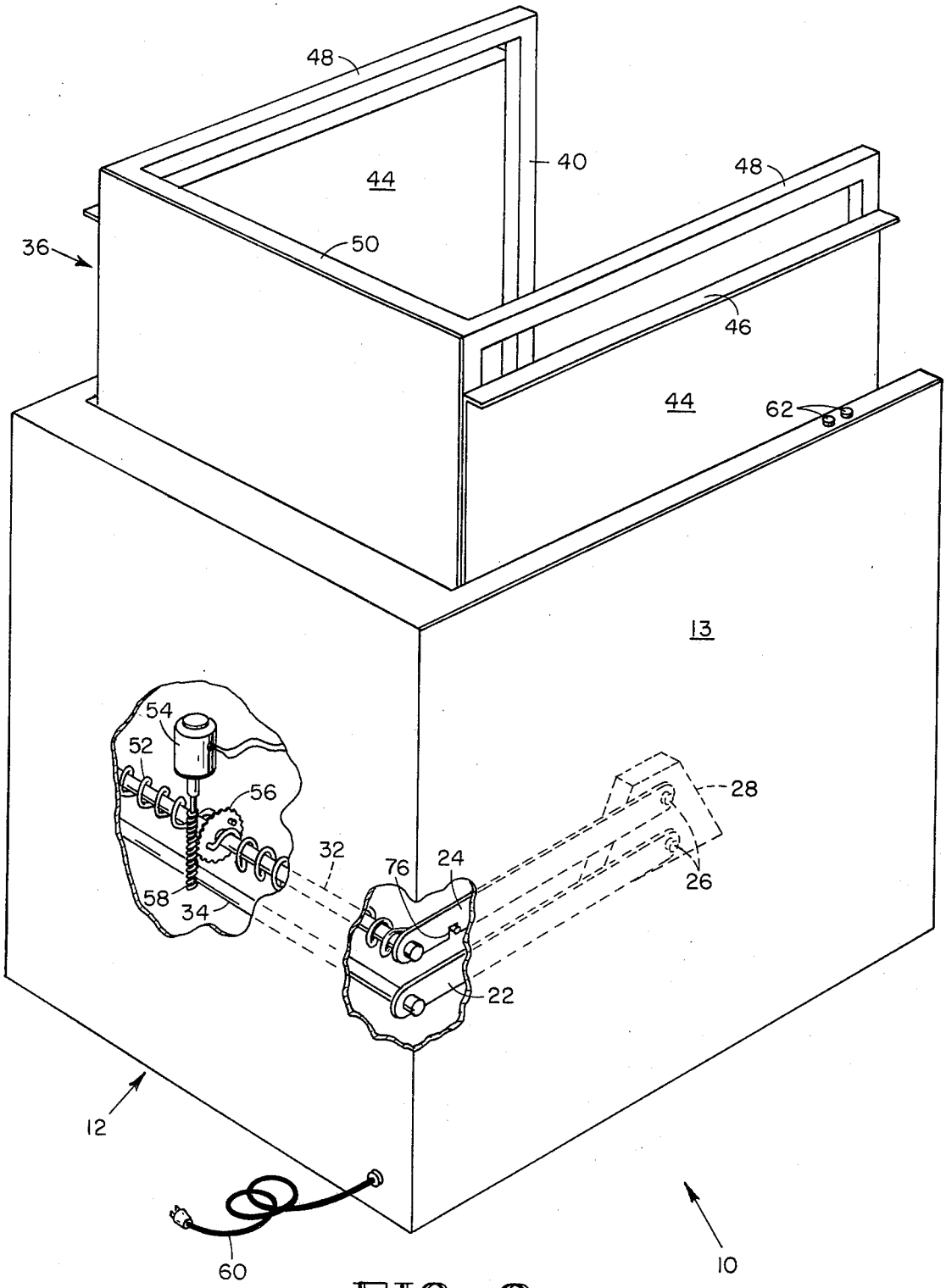
FIG. 2 is a sectionally cut-away view of the invention therapeutic device showing an alternative spring arrangement positioned on the actuating means of the device.

FIG. 2 shows the same invention device 10 as in FIG. 1 with the exception of the spring mechanism. Coiled around upper horizontal arm 32 is a spring of sufficient strength to perform its function in the device. Each end of spring 52 fits in notch 76 located in the forward portion of upper rocker arm 24 to tension hold the spring 52 in position. Located midway and on upper horizontal arm 32 is sprocket 56 to which spring 52 is engaged. Mounted to the outer box 12 by any conventional well-known means is motor 54 having attached thereto worm gear 58. When connected by electrical plug 60 to a source of electricity and activated by controls 62, motor 54 rotates worm gear 58 that is meshed with the teeth of sprocket 56. Movement of worm gear 58 rotates sprocket 56 which in turn increases or decreases the tension on spring 52 as desired. Dual controls 62 provide the selection means of increasing or decreasing the the tension on spring 52. By changing the tension of spring 52, the invention device can be selectively adapted to be used by any size individual from child to adult.

If desired motor 54 may have further controls (not shown) for automatic reversing to provide up and down movement of the inner box 36 without any outside influence.

Figure 3:
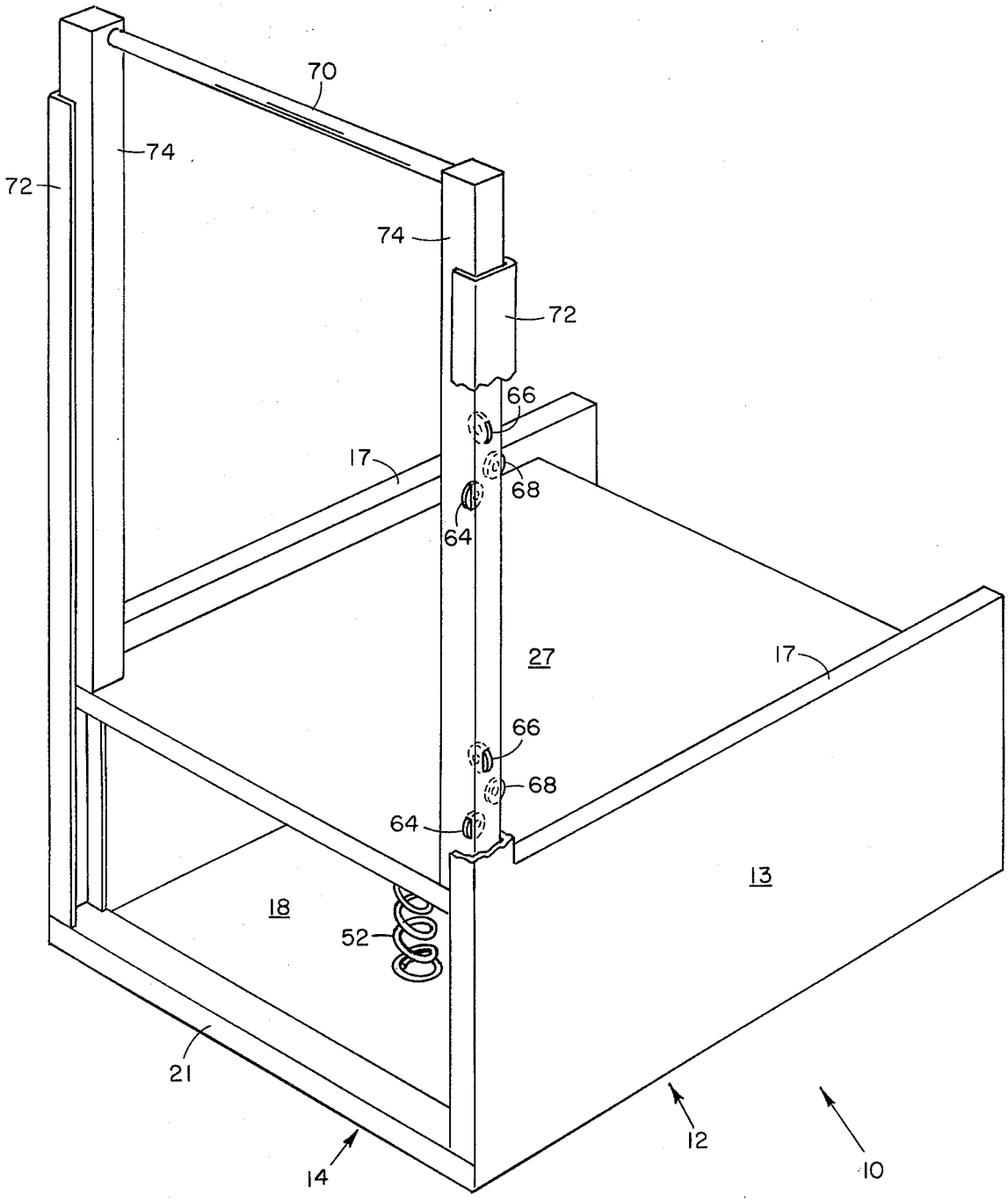
FIG. 3 is a perspective view of an alternative design of the invention therapeutic device showing uprights attached to a platform being guided by rollers in the vertical channels of the box-like outer structure.

FIG. 3, an alternative embodiment of the invention device, shows a body cell therapeutic device 10 comprising an open end outer box 12 and a platform 27, the platform 27 having a pair uprights 74 being received by the vertical channels 72 of outer box 12, the uprights 74 having mounted therein rollers 64, 66 and 68.

The frame 14 of outer box 12 comprises a pair of upper horizontals 17 spaced apart slightly wider than the width of platform 27 and a pair of lower horizontals (not shown) parallel to and spaced apart by the same distance as the upper horizontals 17. Connecting opposing lower horizontals are cross bars 21. To complete the outer box 12 and form the corner posts are a pair of rearward verticals (not shown, but generally the same as rearward vertical 16 of FIG. 1), and the previously mentioned pair of forward vertical channels 72. The rearward verticals (not shown) are attached to the underneath side of upper horizontals 17 in the same manner as described in FIG. 1.

The vertical channels 72 have a U-shaped configuration and are adapted to receive forward rollers 64, side rollers 66, and rearward rollers 68, which comprises a set of rollers. A set of rollers 64,66 and 68 are located near the top of vertical channels 72, and another set of rollers 64,66 and 68 are located near the bottom of vertical channels 72 in close proximity to and above platform 27.

The vertical channels 72 face each other and receive the uprights 74 attached to the forward end of platform 27. To connect uprights 74, and provide a stabilizing means for a user of the device 10, a hand bar 70 is connected between the upper ends of upright 74.

Springs 52 discussed in the description of FIG. 1 may be positioned underneath platform 27 and connect platform 27 to base 18 in the same manner as described in FIG. 1.

As with the devices shown in FIGS. 1 and 2 and described above, the device 10 in FIG. 3 is constructed of strong, sturdy durable materials. The outer box frame 14, the vertical channels 72 and uprights 74 may all be made of steel. Walls 13, base 18, and platform 27 may also be made of steel or wood or similar material having characteristics that would render it suitable for the intended use.

The platform 27 of all of the embodiments discussed and shown in FIGS. 1, 2, and 3 is rigid so as to enable a person confined to a wheelchair or otherwise unable to stand to also benefit from the invention device.

Handrails 48 shown in FIGS. 1 and 2 and hand bar 70 shown in FIG. 3 are for stability and provide a means for a device user to balance himself.

METHOD OF OPERATION

In any of FIG. 1, 2 or 3, a person is located on the platform 27 and is moved, by their own effort, that of someone else's, or by a motor driven reciprocal drive, in an up and down motion.

When operated by their own effort, the user bounces slightly in an up and down motion. This motion is transferred through the platform 27 to the springs 52 that compress (or extend) and respond accordingly causing the platform to rebound upward, and by gravity subsequently downward. The user by exerting slight effort to bounce adds to the downward thrust to initiate and sustain the motion as desired.

Someone else may aid the slight effort applied to the platform 27 to initiate and/or sustain the motion.

A reciprocal drive may be used either in combination with, or without, the springs to provide the up and down motion at a desired rate.

By repetitiously inducing controlled stress below the rupture threshold, with up and down motion, the three forces previously discussed (acceleration, deceleration and gravity) all act upon the body components, organs and functions with resultant strengthening and improvement. The rupture threshold is that point below which the body cells are not damaged, but benefit from the stress incurred.

The number of repetitions, frequency and height of each stroke may be best prescribed by a physician knowledgeable in the effects of the invention device and the present condition of the user.

The construction and operation of the device of this invention has been described in detail. What is desired to be claimed is all modifications and adaptations of this invention not departing from the scope of equivalents as defined in the appended claims.

I claim:

1. A therapeutic device to apply measurable and controllable repetitions of G-force to a body and its components to effect strengthening and functional benefits thereof comprising:

a platform having a generally horizontal surface;

a base;

support means connecting said platform to said base to maintain said platform rigidly horizontal during oscillations of up and down movement initiated and sustained by any means;

said support means including at least two attachment blocks rigidly attached to said platform with two upper and two lower parallel rocker arms having first ends thereof pivotally attached to said attachment blocks, said rocker arms extending to and pivotally attaching via second ends thereof to said base by means of an interconnection between said second ends, said interconnecting means rigidly connecting at least one pair of said rocker arms.

2. The device of claim 1 having actuating means connected to said platform to initiate and sustain said oscillations.

3. The device of claim 2 wherein each of said support means includes a first vertical attachment of said platform which slidably engages a second vertical attachment of said base.

4. The device of claim 3 wherein said support means further includes bearing means between said first and second vertical attachments.

5. The device of claim 4 where said actuating means is spring like and connects between said platform and said base.

6. The device of claim 2 wherein said actuating means is a reciprocal drive powered by a motor.

7. The device of claim 6 wherein said actuating means is a said reciprocal drive in combination with a spring like actuating means.

8. The device of claim 1 wherein said actuating means is spring-like and connects between said platform and said base.

9. The device of claim 8 wherein said spring like actuating means is adjustable.

10. The device of claim 1 wherein at least two of said rocker arms on the same plane are rigidly connected with at least one connecting bar.

11. The device of claim 1 wherein said platform can be mechanically lowered and raised.

12. The device of claim 1 further comprising a vertical upright for said pivotal attachment of said upper and lower rocker arms to said base, said interconnecting means including connecting parallel bars between said upper rocker arms and between said lower rocker arms.

13. The device of claim 1 or 12 wherein at least one hand support bar is attached to said platform.

* * * * *